US006810613B2

(12) United States Patent
Beretta

(10) Patent No.: US 6,810,613 B2
(45) Date of Patent: Nov. 2, 2004

(54) SUPPLEMENTARY SAFETY DEVICE FOR LIGHT FIREARMS

(75) Inventor: Ugo Gussalli Beretta, Brescia (IT)

(73) Assignee: Fabbrica D'Armi Pietro Beretta S.p.A., Gardone Val Trompia Brescia (IT)

( * ) Notice: Subject to any disclaimer, the term of this patent is extended or adjusted under 35 U.S.C. 154(b) by 0 days.

(21) Appl. No.: 10/142,819

(22) Filed: May 10, 2002

(65) Prior Publication Data

US 2002/0170223 A1 Nov. 21, 2002

(30) Foreign Application Priority Data

May 18, 2001 (IT) ..... BS2001A000036

(51) Int. Cl.[7] ..... F41A 17/00

(52) U.S. Cl. ..... 42/70.11; 42/70.01; 42/96; 89/27.12; 89/142; 89/148; 89/180

(58) Field of Search ..... 42/70.11, 70.01, 42/96; 89/27.12, 142, 148, 180, 187.02

(56) References Cited

U.S. PATENT DOCUMENTS

| | | | | | |
|---|---|---|---|---|---|
| 2,923,323 | A | * | 2/1960 | Franck | 138/89 |
| 4,908,971 | A | | 3/1990 | Chaney | |
| 5,044,105 | A | * | 9/1991 | Lindley et al. | 42/70.11 |
| 5,115,589 | A | * | 5/1992 | Shuker | 42/70.11 |
| 5,289,653 | A | * | 3/1994 | Szebeni et al. | 42/70.11 |
| 5,950,344 | A | | 9/1999 | Ross | |
| 6,226,914 | B1 | * | 5/2001 | Reed | 42/70.11 |
| 6,405,472 | B1 | * | 6/2002 | Dojcsak | 42/70.11 |
| 6,502,344 | B1 | * | 1/2003 | Zeh et al. | 42/70.11 |
| 6,526,684 | B1 | * | 3/2003 | Hickerson | 42/70.11 |

FOREIGN PATENT DOCUMENTS

| | | | | |
|---|---|---|---|---|
| DE | 299 20 918 U1 | | 5/2001 | |
| EP | 600789 A1 | * | 6/1994 | F41A/17/44 |
| FR | 2 808 081 | | 10/2001 | |
| GB | 2215822 A | * | 9/1989 | F41C/17/08 |

* cited by examiner

*Primary Examiner*—Jack Karn
*Assistant Examiner*—L. Semunegus
(74) *Attorney, Agent, or Firm*—McGlew and Tuttle, P.C.

(57) ABSTRACT

This invention concerns a supplementary safety device in the form of a false cartridge to be inserted into the chamber of a light firearm barrel, including a radially expandable portion controlled by a lock operated by a specific key for locking/unlocking it in the barrel in which it is housed, so it may be removed only voluntarily.

14 Claims, 4 Drawing Sheets

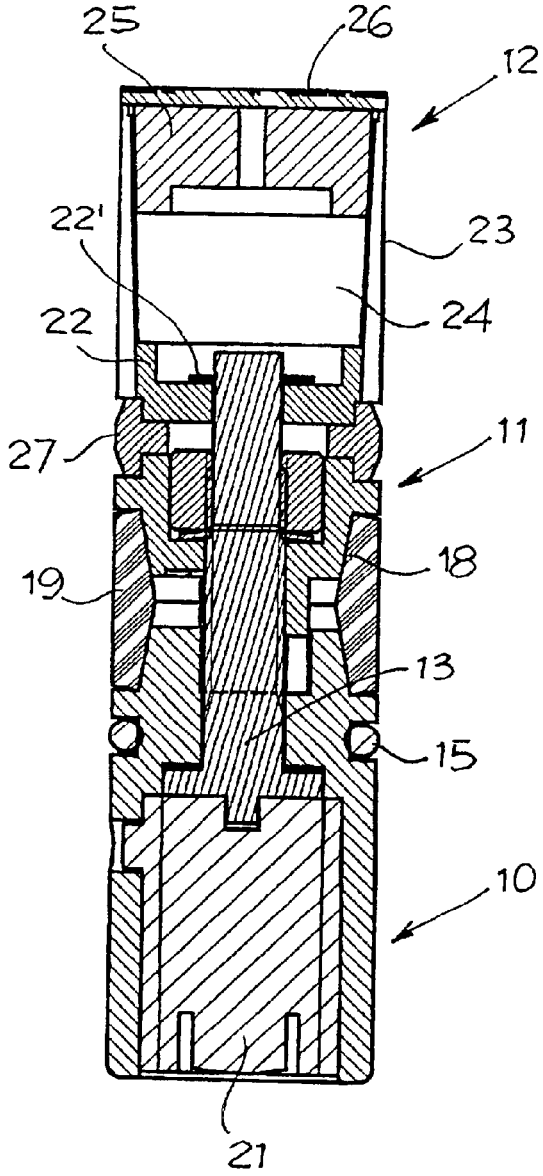
Fig. 4
Fig. 3
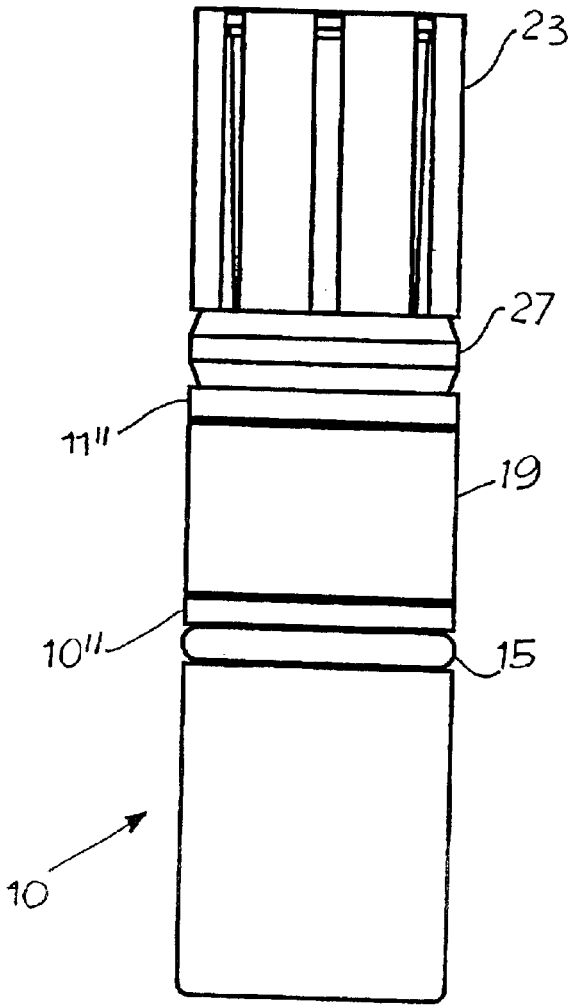

SUPPLEMENTARY SAFETY DEVICE FOR LIGHT FIREARMS

INVENTION FIELD

This invention concerns, in general, the field of light firearms, both long and short barrelled such as parallel barrel or over-and-under shotguns, rifles, handguns etc., and in particular refers to a safety device for these arms, namely a mechanical supplementary safety device in the form of a false cartridge.

STATE OF THE ART

On the one hand the use of so-called false cartridges is already established: devices inserted into the chamber of the barrel(s) of a light firearm when it is not in use, in place of a real cartridge, with view to at least preventing the gun going off accidentally and indicating that it cannot be arbitrarily used. These means however have no real safety device function in the sense that they cannot effectively block abusive use of the firearm since the false cartridge may easily be removed without specific tools even by a child or by unauthorised and incompetent persons.

On the other hand, though the firearms mentioned above are usually equipped with safety catches with the function of preventing them going off accidentally, for example by blocking the trigger mechanism and/or the hammer action, today there is a pressing demand and consequent need to equip these arms with an additional safety device that can be activated and deactivated by a personalised means available only to the owner of the firearm or someone delegated thereby, thus avoiding effective use of the firearm by unauthorised persons.

PURPOSES AND SUMMARY OF THE INVENTION

One purpose of this invention is to offer a supplementary safety device created in the form of a false cartridge which can be inserted and stably locked in the chamber of light firearms without the possibility of removal other than voluntary and only by using a specific means correlated to the device itself.

Another purpose of the invention is to supply a mechanical safety device that fully corresponds to the current, sought-after requirement of increased safety in the use of light firearms such as to permit their use only and exclusively to those who have a personalised method, such as a key, that can control and remove the device once the latter has been activated.

A further purpose of the invention is to create and supply a safety device for light firearms, shotguns, rifles, handguns and similar that is supplementary to the safety catches with which these firearms are already equipped.

Yet another purpose of the invention is to supply a safety device for the above mentioned firearms that has two distinct locking sections for maximum efficiency: the first section can be voluntarily activated and deactivated by a specific and personalised method, while the second section, normally inactive, is activated following surreptitious attempted breakage and removal of the device when it is locked in the barrel of a firearm.

The invention achieves these purposes with a mechanical safety device for light firearms, with a first body including a lock with a rotating part controlled by a specific key. A second body is linked to the first body and is axially movable with respect to the second body without rotating with respect to the second body. The second body is axially movable between a position of unlocking when distant from, and locking when close to, the first body. A screw pin is drivable in rotation in the first body without moving axially in the first body. The screw pin is connected to, and controlled by, the lock for its rotation, and is linked directly or indirectly with the second body for the movement thereof between the positions of unlocking and locking following the turning of the screw pin. A flexible element deformable by compression, is located between the first and second bodies in order to expand radially and project peripherally from the bodies when the second body is in the locking position, thus creating the locking of the device in the chamber of the barrel in which it is housed.

Correspondingly, the safety device proposed herewith, substantially in the form of a false cartridge or of a form suitable for insertion into the chamber of a firearm, possesses first of all a radially expandable portion controlled by a lock and specific key for locking/unlocking it in the barrel in which it is lodged, thus making it removable only voluntarily.

However, depending on the state and/or the lubrication of the barrel cartridge chamber internal surface, this controlled expansion lock might not prevent the sliding and forced ejection of the device if axial thrust were to be applied by means of a tool such as a rod, inserted into the muzzle of the barrel.

So the second locking portion of the device is aimed at preventing all unauthorised forced removal, thanks to an accentuation of the locking action. In fact any axial thrust applied to the device with the intention of ejecting it from the part of its introduction into the barrel results in activation of this second portion which, expanding, tightens against the interior of the barrel; and the greater the thrust the greater the tightening. The advantages of the new supplementary safety device invention may therefore be summarised as follows:

great ease, convenience and immediacy of use;

maximum efficiency and reliability in preventing unauthorised use of the firearm;

possibility of breakage minimised, and even more so if the command lock is made in drill-resistant material.

Moreover, its configuration and absence of appendices mean that when the device is set in place in the chamber it offers no part that might be gripped by an extracting tool. Lastly, a safety device of this type may be easily manufactured and adapted with the same efficacy and safety to firearms of all calibres, without any modification of the firearm whatsoever.

BRIEF DESCRIPTION OF THE DRAWINGS

The invention is described in greater detail below with reference to the attached indicative and not limitative drawings in which:

FIG. 3 shows an external view of the assembled device;

FIG. 4 shows the device in longitudinal section;

DETAILED DESCRIPTION OF THE INVENTION

Figure 1:
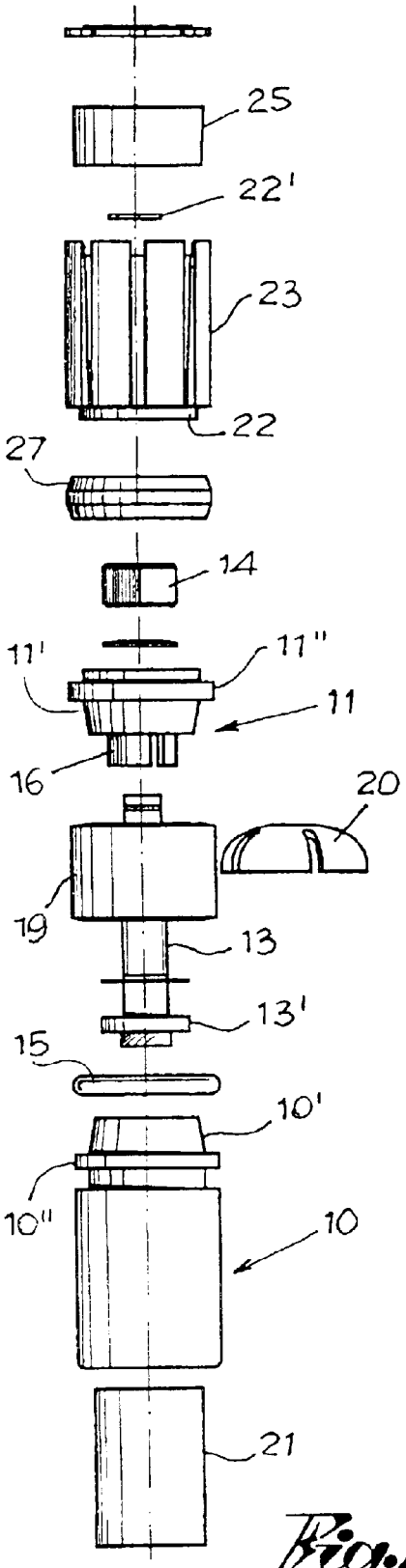
FIG. 1 shows a blow-up view of the elements comprising the device.

The safety device in question is inserted into the chamber of a firearm from the breech towards the muzzle. It consists of a first body 10 pointing towards the breech 28A of the barrel 28, a second intermediate body 11 and a final spigot and socket body 12, this last pointing towards the muzzle 28B. The first body and the second intermediate body are joined and axially moveable each with regard to the other, but without the possibility of rotation, thanks to an axial appendix 16 integral with the intermediate body and having the purpose of insertion into corresponding housing 17 in the first body.

The first body 10 and the intermediate body 11 are joined by a rotating screw pin 13 with head 13' housed in the first body, abutting against a shoulder which impedes axial movement of the pin without obstructing its rotation. The screw pin 13 may be screwed directly to the intermediate body 11 or, as shown in the drawings, to a threaded element 14 associated with that body, in such a way that rotation of the screw pin in one direction causes the approach and in the other direction the distancing of the intermediate body with regard to the first body.

An anti-rotation gasket 15 is mounted around the first body 10 to prevent rotation of the device when it is placed in the chamber for use.

The contiguous extremities 10' and 11' of the two bodies 10 and 11 respectively are in truncated cone form and extend from the respective shoulders 10" and 11". Together they delimit an annular peripheral housing 18 at which level is envisaged at least one deformable and expandable by compression element such as, for example, a gasket 19 in an elastomer material, a cup spring 20, or some other element, which is radially squeezed and expanded between the two shoulders 10" and 11" when the two bodies 10 and 11 are brought together.

Figure 2:
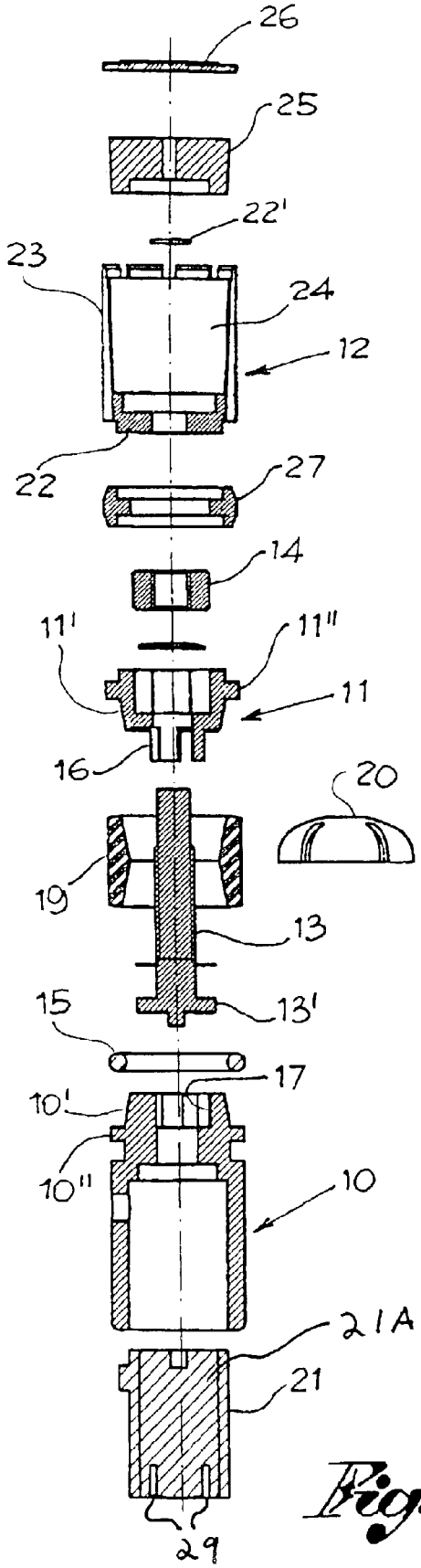
FIG. 2 shows an analogous blow-up view of the elements of FIG. 1, but in section.

The first body 10 houses and retains a safety lock 21, linked with the screw pin 13 for rotation of the latter and activated by means of a personalized key supplied to the firearm owner. In the embodiment of FIGS. 2 and 4, the lock 21 has a rotating part 21A defining a seat 29 for receiving the key. Other lock and key type arrangements are also possible.

So when the device is placed in the chamber of a firearm barrel, by turning the screw pin 13 with lock and key in one direction, the intermediate body 11 is brought close to the first body 10 and there is consequent radial expansion of the expandable element 19 or 20, resulting in the device being locked into the chamber. Thus the device cannot be extracted from the breech and the firearm cannot be used by unauthorised persons or those not in possession of the key. Turning the key and therefore the screw pin in the opposite direction, the device is unlocked.

The spigot and socket body 12 is linked to the forward extremity of the intermediate body 11 by the interposing of a spacer 27. This is axially bound to the free extremity of the screw pin 13, for example by a Seeger 22', and has a side wall 23 which is winged and expandable and delimits a conical cavity 24, tapering towards the bottom of the body itself. The cavity contains an axially moveable conical plug 25 and is closed by a cover 26 to prevent exit of the plug.

So when the safety device has been locked in the barrel of the firearm with the special key, any action or thrust on the device, perhaps with a rod inserted into the muzzle with view to ejecting the device at the breech, will cause in-depth penetration of the conical plug 25, consequent expansion of the winged wall 23 of the spigot and socket body against the internal wall of the barrel and an accentuation of the blocking of the device, making it practically immoveable also in such cases.

Figure 5:
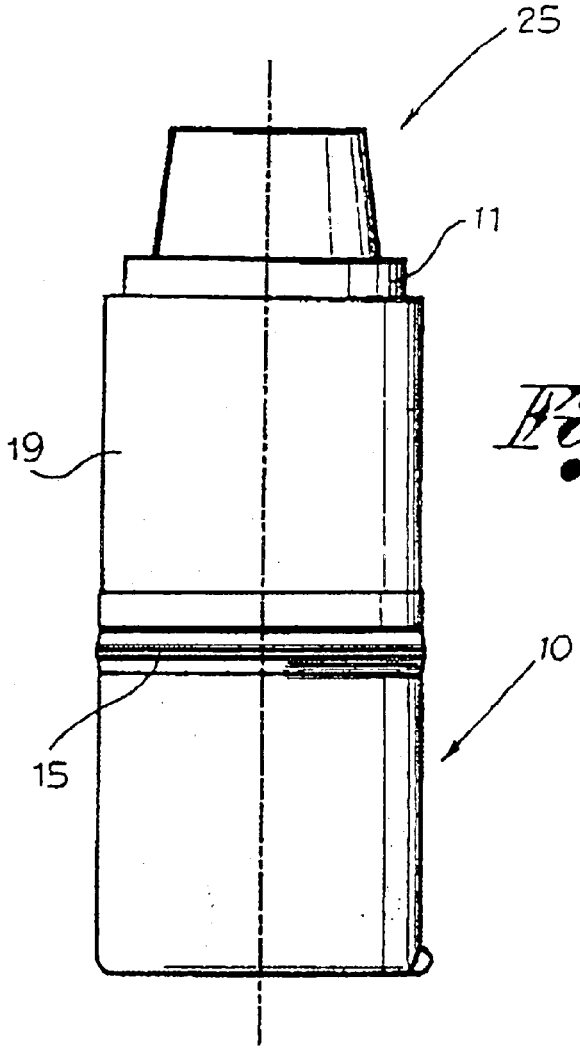
FIG. 5 shows an external view of the device in a variant version.
Figure 6:
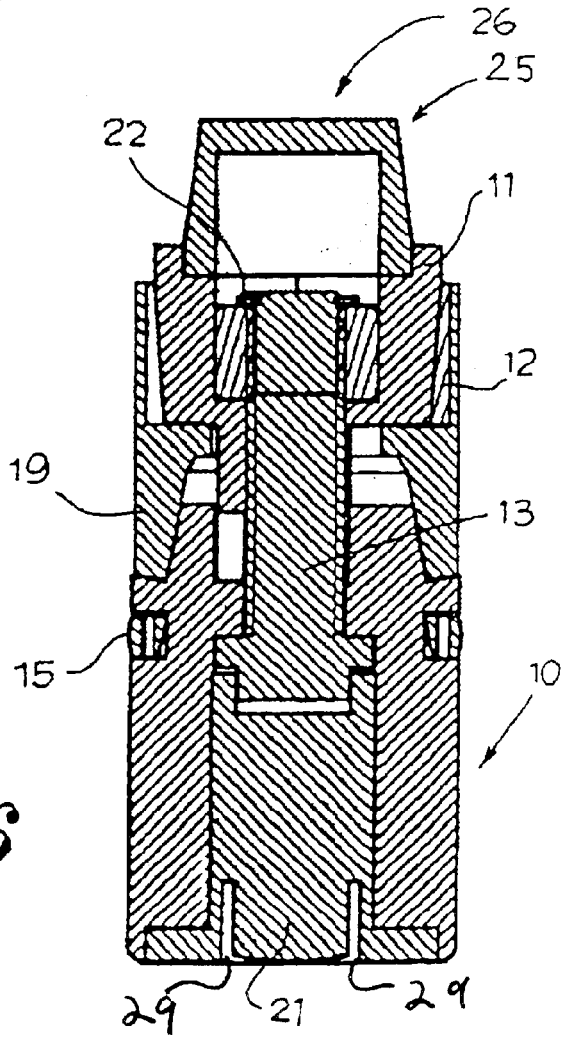
FIG. 6 shows the FIG. 5 device in longitudinal axial section.
Figure 7:
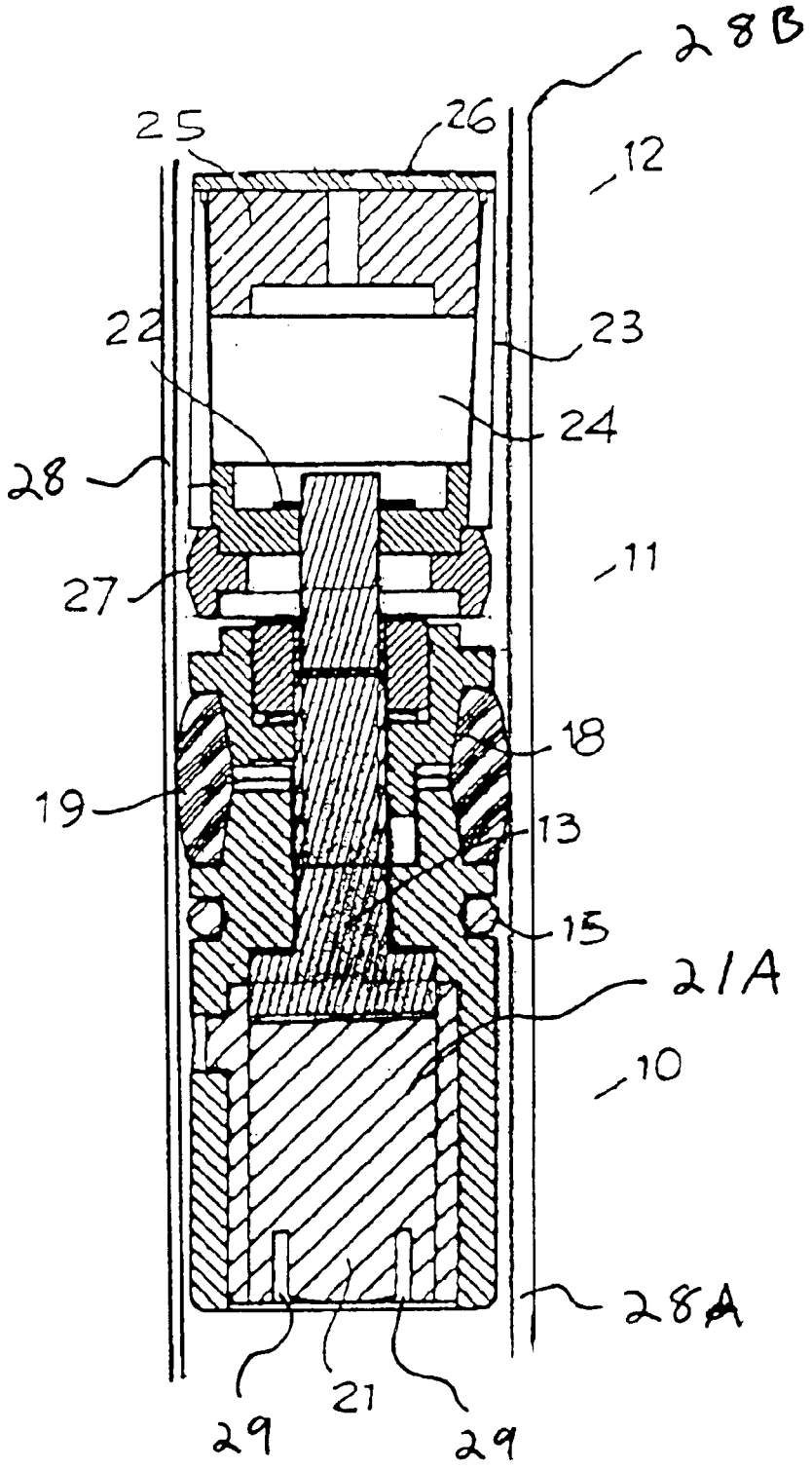
FIG. 7 is a longitudinal sectional view of the assembled device situated inside the barrel of a firearm in a locked state.

The same result is obtained, as shown FIGS. 5 and 6, when the spigot and socket body is not independent but integrated with or integral to the intermediate body.

Lastly it should be noted that as a means of impeding forced and unauthorized ejection of the device from a firearm barrel 28, the spigot and socket body could be replaced by other elements such as a permanent deformation organ, a conical screw or an inclined sector, without this being a departure from the context of the invention.

While specific embodiments of the invention have been shown and described in detail to illustrate the application of the principles of the invention, it will be understood that the invention may be embodied otherwise without departing from such principles.

What is claimed is:

1. A supplementary safety device that may be inserted into the chamber of light firearms including at least one of shotguns, rifles and handguns, the safety device comprising:

a first body including a lock with a rotating pan controlled by a specific key;

a second body movably connected to the first body in an axial direction without rotating, between a position of unlocking with a position distant from the first body and a position of locking with a position close to the tint body, said second body being rotationally fixed with said first body;

a screw pin driven in rotation without moving axially in the first body, the screw pin being connected to and controlled by the lock for rotation of said screw pin and to be linked directly or indirectly with the second body for the movement of the second body between the positions of unlocking and locking following the turning of the screw pin; and a flexible element deformable by compression and located between the first and second bodies in order to expand radially and project peripherally from the first and second bodies when the second body is in the locking position, thus creating the locking of the device in the chamber of the barrel in which it is housed, wherein the screw pin is screwed to the second body.

2. A supplementary safety device that may be inserted into the chamber of light firearms including shotguns, rifles and handguns, the safety device comprising:

a first body including a lock with a rotating part controlled by a specific key;

a second body movably connected to the first body in an axial direction without rotating, between a position of unlocking with a position distant from the first body and a position of locking with a position close to the first body, said second body being rotationally fixed with said first body;

a screw pin driven in rotation without moving axially in the first body, the screw pin being connected to and controlled by the lock for rotation of said screw pin and to be linked directly or indirectly with the second body for the movement of the second body between the positions of unlocking and locking following the tanning of the screw pin;

a flexible element deformable by compression and located between the first and second bodies in order to expand radially and project peripherally from the first and second bodies when the second body is an the locking position, thus creating the locking of the device in the chamber of the barrel in which it is housed;

a third body associated and in line with the second body and with an expandable winged wall delimiting a conical cavity; and a conical plug located and axially moveable in the conical cavity of the third body to radially expand the winged wall and additionally lock the device in the barrel if the plug is subject to thrust in the direction of the chamber in an attempt to eject the device.

3. A supplementary safety device that may be inserted into the chamber of light firearms including at least one of shotguns, rifles and handguns, the safety device comprising:

a first body including a lock with a rotating part controlled by a specific key;

a second body movably connected to the first body in an axial direction without rotating, between a position of unlocking with a position distant from the first body and a position of locking with a position close to the first body, said second body being rotationally fixed with said first body;

a screw pin driven in rotation without moving axially in the first body, the screw pin being connected to and controlled by the lock for rotation of said screw pin and to be linked directly or indirectly with the second body for the movement of the second body between the positions of unlocking and locking following the turning of the screw pin;

a flexible element deformable by compression and located between the first and second bodies in order to expand radially and project peripherally from the first and second bodies when the second body is in the locking position, thus creating the locking of the device in the chamber of the barrel in which it is housed, wherein the first and second bodies are linked with axial and anti-rotation coupling portions.

4. A supplementary safety device that may be inserted into the chamber of light firearms including at least one of shotguns, rifles and handguns, the safety device comprising:

a first body including a lock with a rotating part controlled by a specific key;

a second body movably connected to the first body in an axial direction without rotating, between a position of unlocking with a position distant from the first body and a position of locking with a position close to the first body, said second body being rotationally fixed with said first body;

a screw pin driven in rotation without moving axially in the first body, the screw pin being connected to and controlled by the lock for rotation of said screw pin and to be linked directly or indirectly with the second body for the movement of the second body between the positions of unlocking of and locking following the turning of the screw pin;

a flexible element deformable by compression and located between the first and second bodies in order to expand radially and project peripherally from the first and second bodies when the second body is in the locking position, thus creating the locking of the device in the chamber of the barrel an which it is housed, wherein the flexible deformable by compress ion element consists of one of a gasket in an elastomer material or of a spring and is placed between two annular shoulders, at the level of truncated conical portions integral with the first and second bodies.

5. A supplementary safety device that may be inserted into the chamber of light firearms including at least one of shotguns, rifles and handguns, the safety device comprising:

a first body including a lock with a rotating part controlled by a specific key;

a second body movably connected to the first body in an axial direction without rotating, between a position of unlocking with a position distant from the first body and a position of locking with a position close to the first body, said second body being rotationally fixed with said first body;

a screw pin driven in rotation without moving axially in the first body, the screw pin being connected to and controlled by the lock for rotation of said screw pin and to be linked directly or indirectly with the second body for the movement of the second body between the positions of unlocking and locking following the turning of the screw pin;

a flexible element deformable by compression and located between the first and second bodies in order to expand radially and project peripherally from the first and second bodies when the second body is in the locking position, thus creating the locking of the device in the chamber of the barrel in which it is housed, wherein at least around the first body an anti-rotation gasket is mounted to prevent rotation of the device when placed in the chamber.

6. A safety device in accordance with claim 2, wherein the third body is axially limited in movement at a free end of the screw pin and is linked to the second body with the interposing of a spacer.

7. A safety device in accordance with claim 2, wherein the third body is one of independent from, integrated with or integral to the second body.

8. A supplementary safety device that may be inserted into the chamber of light firearms including at least one of shotguns, rifles and handguns, the safety device comprising:

a first body including a lock with a rotating part controlled by a specific key;

a second body movably connected to the first body in an axial direction without rotating, between a position of unlocking with a position distant from the first body and a position of locking with a position close to the first body, said second body being rotationally fixed with said first body;

a screw pin driven in rotation without moving axially in the first body, the screw pin being connected to and controlled by the lock for rotation of said screw pin and to be linked directly or indirectly with the second body for the movement of the second body between the positions of unlocking and locking following the turning of the screw pin;

a flexible element deformable by compression and located between the first and second bodies in order to expand radially and protect peripherally from the first and second bodies when the second body is in the locking position, thus creating the locking of the device in the chamber of the barrel in which it is housed, wherein an anti-rotation device is arranged on said first body to hold said first body rotationally fixed in the chamber.

9. A firearm safety arrangement comprising:

a firearm barrel having a muzzle end and a breech end;

a first body having a shape for inserting into said barrel;

a pin rotatably mounted in said first body;

a second body rotatably connected to said pin, said first and second bodies having a connection to said pin where relative rotation of said pin with respect to one of said bodies causes said bodies to move toward and away from each other;

an expandable element arranged around said pin and arranged between said first and second bodies, said first and second bodies and said expandable element having a shape, and said expandable element being formed of a material to have said expandable element expand when said first and second bodies move toward each other;

a lock arranged in said first body and rotationally fixed to said pin, said lock being selectively rotatable in said first body by a key, wherein said first body is arranged in said barrel adjacent said breech end;

an anti-rotation device is arranged on said first body to hold said first body rotationally fixed in the barrel and against the barrel.

10. An arrangement in accordance with claim 9, wherein:

an axial appendage extends from one of said first and second bodies to the other of said first and second bodies to rotationally fix said first and second bodies to each other.

11. An arrangement in accordance with claim 10, wherein:

said axial appendage is integral with said second body and is inserted into said first body to rotationally fix said first and second bodies together.

12. A firearm safety arrangement comprising:

a firearm barrel having a muzzle end and a breech end;

a first body having a shape for inserting into said barrel;

a pin rotatably mounted in said first body;

a second body rotatably connected to said pin, said first and second bodies having a connection to said pin where relative rotation of said pin with respect to one of said bodies causes said bodies to move toward and away from each other;

an expandable element arranged around said pin and arranged between said first and second bodies, said first and second bodies and said expandable element having a shape, and said expandable element being formed of a material to have said expandable element expand when said first and second bodies move toward each other;

a lock arranged in said first boy and rotationally fixed to said pin, said lock being selectively rotatable in said first body by a key. An arrangement in accordance with claim 16, further comprising:

a third body connected to said second body on a muzzle side of said second body, said third body having expansion structure to expand and stop movement of said bodies in the barrel when said third body it forced toward said second body; and a third body connected to said second body on a muzzle side of said second body, said third body having expansion structure to expand and stop movement of said bodies in the barrel when said third body is forced toward said second body.

13. A firearm safety device, comprising:

a first body having a shape for inserting into a barrel of a firearm;

a pin rotatably mounted in said first body;

a second body rotatably connected to said pin, said first and second bodies having a connection to said pin where relative rotation of said pin with respect to one of said bodies causes said bodies to move toward and away from each other;

an expandable element arranged around said pin and arranged between said first and second bodies, said first and second bodies and said expandable element having a shape, and said expandable element being formed of a material to have said expandable element expand when said first and second bodies move toward each other;

a lock arranged in said first body and rotationally fixed to said pin, said lock being selectively rotatable in said first body by a key; and an anti-rotation device is arranged on said first body to hold said first body rotationally fixed in the barrel and against the barrel.

14. A firearm safety device comprising:

a first body having a shape for inserting into a barrel of a firearm;

a pin rotatably mounted in said first body;

a second body rotatably connected to said pin, said first and second bodies having a connection to said pin where relative rotation of said pin with respect bone of said bodies causes said bodies to move toward and away from each other;

an expandable element arranged around said pin and arranged between said first and second bodies, said first and second bodies and said expandable element having a shape, and said expandable element being formed of a material to have said expandable element expand when said first and second bodies move toward each other;

a lock arranged in said first body and rotationally fixed to said pin, said lock being selectively rotatable in said first body by a key; and a third body connected to said second body, said third body having expansion structure to expand and stop movement of said bodies in the barrel when said third body is forced toward said second body.

* * * * *